US008474813B2

(12) United States Patent
Cheng et al.

(10) Patent No.: US 8,474,813 B2
(45) Date of Patent: Jul. 2, 2013

(54) BLOCKING MODULE AND MULTI-FUNCTION PRINTER USING THE SAME

(75) Inventors: Kai-Yuan Cheng, New Taipei (TW); Chi-Tsung Chen, New Taipei (TW); Po-Chih Chang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/284,977

(22) Filed: Oct. 30, 2011

(65) Prior Publication Data

US 2012/0146283 A1 Jun. 14, 2012

(30) Foreign Application Priority Data

Dec. 14, 2010 (TW) ..... 99143768 A
Jun. 20, 2011 (TW) ..... 100121428 A

(51) Int. Cl.
*B65H 3/52* (2006.01)

(52) U.S. Cl.
USPC ..... 271/121

(58) Field of Classification Search
USPC ..... 271/245, 256, 121, 117
See application file for complete search history.

(56) References Cited

U.S. PATENT DOCUMENTS

| | | | | |
|---|---|---|---|---|
| 6,431,541 | B2 * | 8/2002 | Kuo et al. | 271/118 |
| 6,557,848 | B2 * | 5/2003 | Hsiao et al. | 271/245 |
| 6,991,227 | B2 * | 1/2006 | Kim | 271/10.12 |
| 7,837,188 | B2 | 11/2010 | Lee et al. | |
| 2010/0295234 | A1 | 11/2010 | Liu | |

* cited by examiner

*Primary Examiner* — Michael McCullough
(74) *Attorney, Agent, or Firm* — Jianq Chyun IP Office

(57) ABSTRACT

A blocking module is used for blocking at least an object from passing through a rail. The blocking module includes a linkage member and a blocking member. The linkage member has a first end and a second end, and there is a buffering space at a side of the first end. The blocking member has a pivoting end and a free end, in which the pivoting end is pivoted at the second end and the free end hangs down under the pivoting end due to gravity. When the free end of the blocking member leans against on the object on the rail, the object applies a counterforce onto the blocking member so as to drive the first end of the linkage member to move towards the buffering space. The invention also discloses a multi-function printer.

7 Claims, 3 Drawing Sheets

BLOCKING MODULE AND MULTI-FUNCTION PRINTER USING THE SAME

CROSS-REFERENCE TO RELATED APPLICATION

This application claims the priority benefits of Taiwan application serial no. 99143768, filed on Dec. 14, 2010, and Taiwan application serial no. 100121428, filed on Jun. 20, 2011. The entirety of each of the above-mentioned patent applications is hereby incorporated by reference herein and made a part of specification.

BACKGROUND OF THE INVENTION

1. Field of the Invention

The invention generally relates to a blocking module, and more particularly, to a blocking module of a multi-function printer.

2. Description of Related Art

Along with that the information society is coming, an office is often equipped with office automatic equipments such as scanner, photocopier or printer, and users can conduct word processing work by using the office automatic equipments. It should be noted that the above-mentioned office automatic equipments disposed in an office would occupy a lot of spaces, which triggers developing a multi-function peripheral (MFP) integrating photocopying, printing and scanning together was developed to solve the above-mentioned problem.

Usually, a user would place a pile of paper sheets at a multi-function printer for photocopying, printing or scanning, in which the multi-function printer requires a blocking module disposed therein so as to properly block a paper sheet prior to feeding the paper sheet into the multi-function printer. In the prior art, a blocking module of multi-function printer employs a gear to drive a gear rack, so that a blocking plate up-down moves in the multi-function printer to block or allow the passing of a paper sheet. However, with such a gear rack transmission, a moving space for the gear rack needs to be preserved on the vertical direction of the multi-function printer, which limits the height design and wastes space, and the overall volume of the multi-function printer is unable to be effectively reduced.

In addition, there is another conventional blocking module, in which the module achieves an effect of blocking or allowing a paper sheet to pass by using mutual-cooperation between a motor, a spring, a paper-picking arm, a retaining arm and a constraining point. However, the spring may be fatigued and the motor sometimes may get a wrong reverse rotation step-number, which would make the paper-blocking plate and the retaining arm unable to return to the positioning zero point and make the blocking module in failure. Moreover, when the cover of the multi-function printer is opened relatively to the body thereof for fixing fault, if a paper sheet still stays on the rail under the paper-blocking plate, then, as the cover is closed after fixing, the blocking module may tear the paper along with closing the cover to its original position at the body.

SUMMARY OF THE INVENTION

Accordingly, the invention is directed to a blocking module with simple structure to block an object from moving on a rail.

The invention is also directed to a multi-function printer, in which a blocking module thereof has simple structure to avoid damaging paper as the module leans against on a paper sheet on the rail.

An embodiment of the invention provides a blocking module for blocking at least an object from passing through a rail. The blocking module includes a linkage member and a blocking member. The linkage member has a first end and a second end, and there is a buffering space at a side of the first end. The blocking member has a pivoting end and a free end, in which the pivoting end is pivoted at the second end and the free end hangs down under the pivoting end due to gravity. When the free end of the blocking member leans against on the object on the rail, the object applies a counterforce onto the blocking member so as to drive the first end of the linkage member to move towards the buffering space.

An embodiment of the invention provides a multi-function printer, which includes a body, a cover and a blocking module. The body has a rail. A paper sheet is suitable to pass through the rail and conveyed into the body. The cover is assembled to the body in opened and closed way. The blocking module includes a linkage member and a blocking member. The linkage member has a rotation shaft and a first end and a second end located at the both opposite sides of the rotation shaft, in which the rotation shaft is freely pivoted at the cover. The blocking member is pivoted at the second end and makes the linkage member rotate in a first direction by means of the gravity thereof. When the blocking member leans against on the paper sheet on the rail, the paper sheet applies a counterforce onto the blocking member so as to drive the linkage member rotating in a second direction, in which the first direction is opposite to the second direction.

In an embodiment of the present invention, the above-mentioned linkage member rotates about the axis of the rotation shaft, and the first end and the second end are respectively located at the both opposite sides of the rotation shaft to form a lever structure.

In an embodiment of the present invention, the above-mentioned rail has a retaining portion and the second end of the linkage member rotates in a first direction under the gravity of the blocking member so that the free end of the blocking member interferes in the retaining portion and blocks the object from passing through the rail.

In an embodiment of the present invention, the above-mentioned blocking module further includes a driving module, in which the first end of the linkage member is located between the driving module and the buffering space, and the driving module moves towards the first end and applies a force onto the first end so as to drive the linkage member rotating in a second direction and make the free end of the blocking member release the interference in the retaining portion, in which the first direction is opposite to the second direction.

In an embodiment of the present invention, after the above-mentioned driving module releases the interference between the blocking member and the retaining portion, the object moves forward along the rail and pushes the free end of the blocking member to rotate in the above-mentioned first direction.

In an embodiment of the present invention, the above-mentioned retaining portion, the pivoting end and the free end of the blocking member are located on a same vertical line.

In an embodiment of the present invention, a front edge of the above-mentioned object leans against the blocking member so that the front edge is perpendicular to the moving direction of the object on the rail.

In an embodiment of the present invention, the above-mentioned rail has a locking slot, and the linkage member rotates in the above-mentioned first direction and drives a free end of the blocking member to be locked at the locking slot so as to block the paper sheet from passing through the rail and entering the body.

In an embodiment of the present invention, the above-mentioned multi-function printer further includes a driving module assembled to the cover and located beside the first end, in which the driving module moves towards the first end and applies a force onto the first end so as to drive the linkage member rotating in the second direction and drive the free end to move away from the locking slot.

In an embodiment of the present invention, the above-mentioned multi-function printer further includes a paper-picking module assembled to the cover, in which when the driving module drives the linkage member to make the blocking member move away from the locking slot, the paper-picking module drives the paper sheet passing through the rail and moving into the body and pushes the blocking member rotating in the first direction.

In an embodiment of the present invention, the above-mentioned blocking member further has a pivoting end freely pivoted at the second end, in which the free end hangs down under the pivoting end due to gravity.

In an embodiment of the present invention, the above-mentioned pivoting end, the free end and the locking slot are located on a same vertical line.

In an embodiment of the present invention, a front edge of the above-mentioned paper sheet leans against on the blocking member and the front edge is perpendicular to the moving direction of the paper sheet on the rail.

In an embodiment of the present invention, the above-mentioned cover is opened relatively to the body, followed by being closed so that the blocking member leans against on the paper sheet on the rail.

Based on the depiction above, in the above-mentioned embodiments of the invention, the linkage member of the blocking module is freely pivoted on the cover and the blocking member is pivoted at one of the first and second ends of the blocking module so as to form a simple lever structure. In this way, the blocking module makes the blocking member able to block the paper sheet from passing through the rail by means of the rotation of the linkage member and can drive the linkage member for reverse rotation by means of a counterforce applied by the paper sheet as the blocking member leans against on the paper sheet on the rail, which can effectively avoid the blocking member from damaging the paper stayed on the rail.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
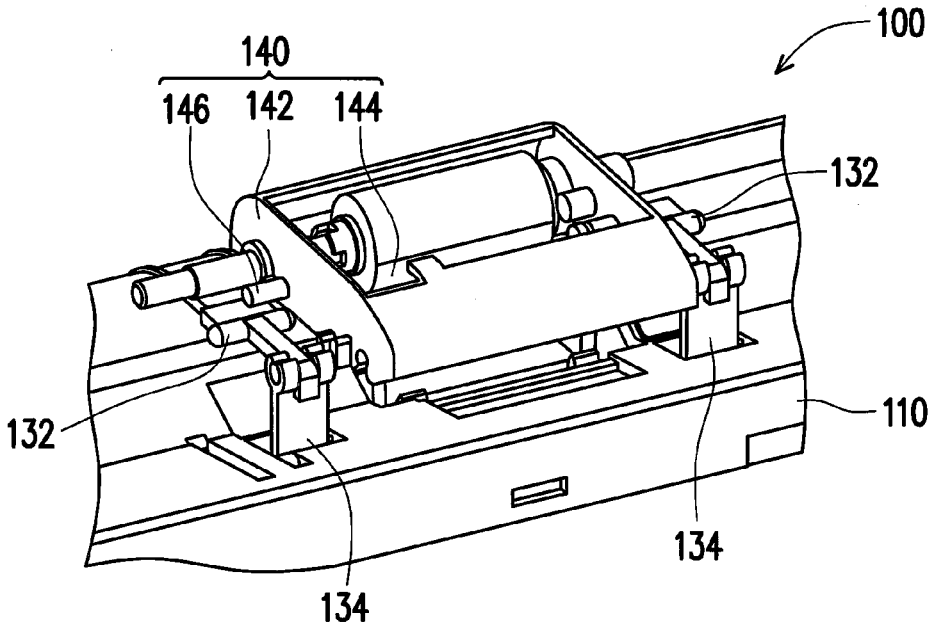
FIG. 1 is a partial schematic diagram of a multi-function printer according to an embodiment of the invention.
Figure 2:
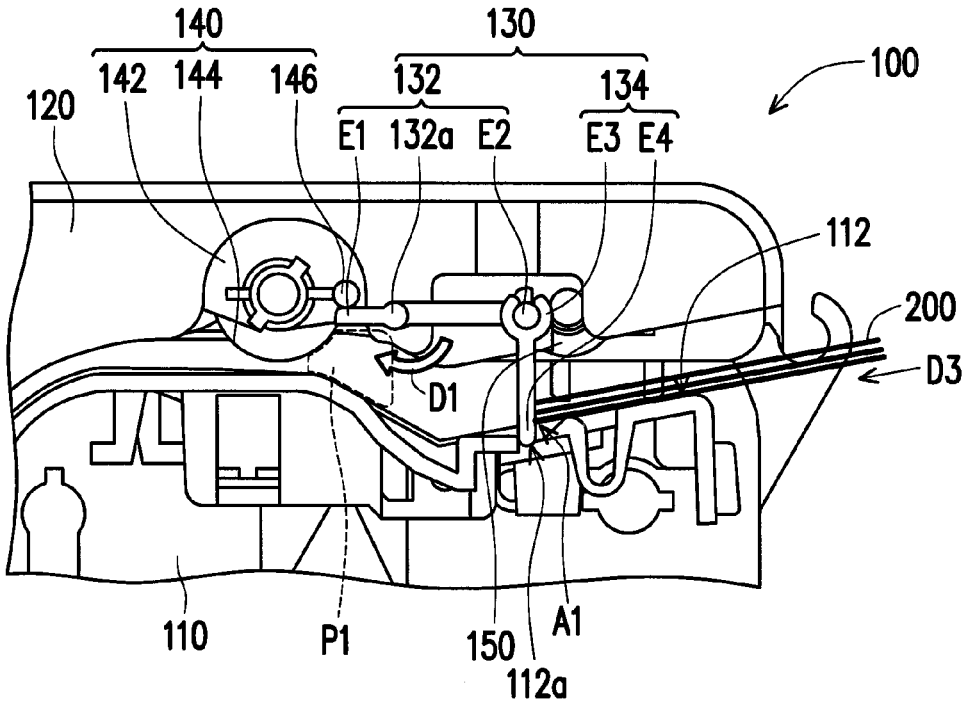
FIG. 2 is a partial side-view schematic diagram of the multi-function printer of FIG. 1.

FIG. 1 is a partial schematic diagram of a multi-function printer according to an embodiment of the invention and FIG. 2 is a partial side-view schematic diagram of the multi-function printer of FIG. 1. Referring to FIGS. 1 and 2, in the embodiment, a multi-function printer 100 includes a body 110, a cover 120, a blocking module 130 and a driving module 140. The body 110 has a rail 112, and at least a paper sheet 200 is suitable to pass through the rail 112 to be conveyed into the body 110. The cover 120 is assembled in opened and closed way to the body 110. The blocking module 130 includes a linkage member 132 and a blocking member 134. The linkage member 132 has a rotation shaft 132*a* and a first end E1 and a second end E2 located at the both opposite sides of the rotation shaft 132*a*. The blocking member 134 is pivoted at the second end E2. The driving module 140 is assembled to the cover 120 and located beside the first end E1.

The rotation shaft 132*a* is freely pivoted on the cover 120 so that the linkage member 132 and the cover 120 are freely pivoted at each other and the two ends E1 and E2 can freely back-and-fourth swing relatively to the rotation shaft 132*a*. In addition, the blocking member 134 is pivoted at the second end E2 of the linkage member 132, so that the blocking member 134 can make the linkage member 132 rotate in a first direction D1 by means of the gravity thereof, which enables the blocking member 134 staying in front of the paper sheet 200 on the rail 112 for achieving the effect of blocking the paper sheet 200 from moving, as shown by FIG. 2.

Figure 3:
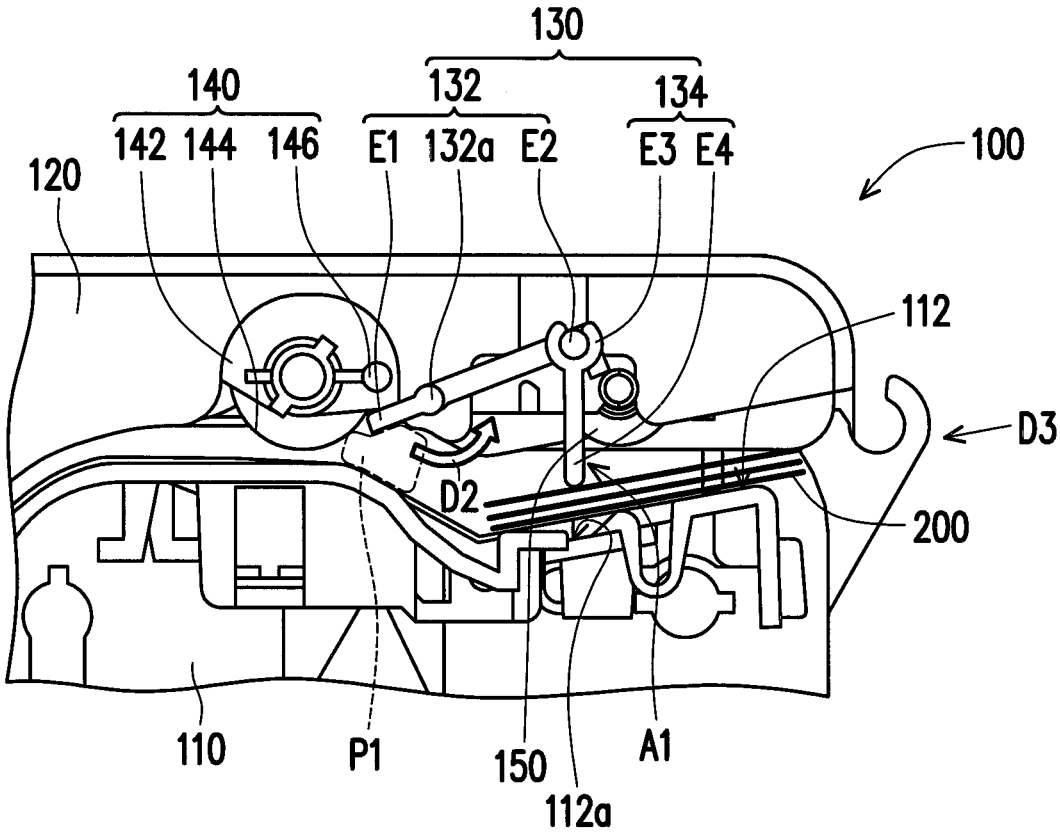
FIG. 3 is a schematic diagram of the multi-function printer of FIG. 2 in another status.

On the other hand, FIG. 3 is a schematic diagram of the multi-function printer of FIG. 2 in another status. Referring to FIGS. 2 and 3, as the blocking member 134 leans against on the paper sheet 200 on the rail 112, the paper sheet 200 applies a counterforce to the blocking member 134 so that the blocking member 134 makes the linkage member 132 rotate in a second direction D2. The first direction D1 and the second direction D2 herein are opposite to each other. In comparison with the prior art, in the multi-function printer 100 of the invention, since the linkage member 132 and the cover 120 are freely pivoted at each other, they can form a free lever structure, i.e., the linkage member 132 can back-and-fourth swing like a seesaw. In this way, as the blocking member 134 leans against on the paper sheet 200, the paper sheet 200 is not damaged, and further, the linkage member 132 reversely rotates (second direction D2), so that the multi-function printer 100 of the invention has better manipulability.

It should be noted that in the figures of the embodiment, the first direction D1 is clockwise direction and the second direction D2 is anticlockwise direction, which the invention is not limited to; that is to say, the above-mentioned directions can be appropriately changed according to the layout of the blocking module 130 in the multi-function printer 100.

In the embodiment, there is a buffering space P1 at a side of the first end E1 of the linkage member 132, a pivoting end E3 of the blocking member 134 is pivoted at the second end E2, and a free end E4 of the blocking member 134 hangs down under the pivoting end E3 due to gravity, which further makes the linkage member 132 rotate in the first direction D1. As the free end E4 leans against on the paper sheet 200, the free lever structure of the linkage member 132 and the cover 120 allows the paper sheet 200 applies a counterforce to the blocking member 134 to make the first end E1 of the linkage member 132 rotate towards the buffering space P1, which avoids the possibility for the blocking member 134 to tear the paper sheet 200 as well.

For example, when the multi-function printer 100 has fault and needs to open the cover 120 relatively to the body 110 for the user to check or maintain, the blocking module 130 would move away from the rail 112 along with opening the cover 120. At the time, due to no blocking of the blocking member 134, the paper sheet 200 on the rail 112 would move along a forward direction D3 until leaning against the body 110 (as shown by FIG. 3). At the time, if the user finishes fix and closes the cover 120 to the body 110, the blocking member 134 of the blocking module 130 would directly press down onto the paper sheet 200 on the rail 112. However for a conventionally designed blocking member, usually limited by a transmission module, the paper sheet 200 would be directly torn. The blocking module 130 of the invention has a buffering space P1 at a side of the first end E1 of the linkage member 132, so that the linkage member 132 and the cover 120 are freely pivoted at each other, which allows the counterforce applied by the paper sheet 200 makes the linkage member 132 reversely rotate (in the second direction D2) during the blocking member 134 is leaning against on the paper sheet 200, and the invention thereby can effectively avoid the paper sheet 200 from being torn.

Figure 4:
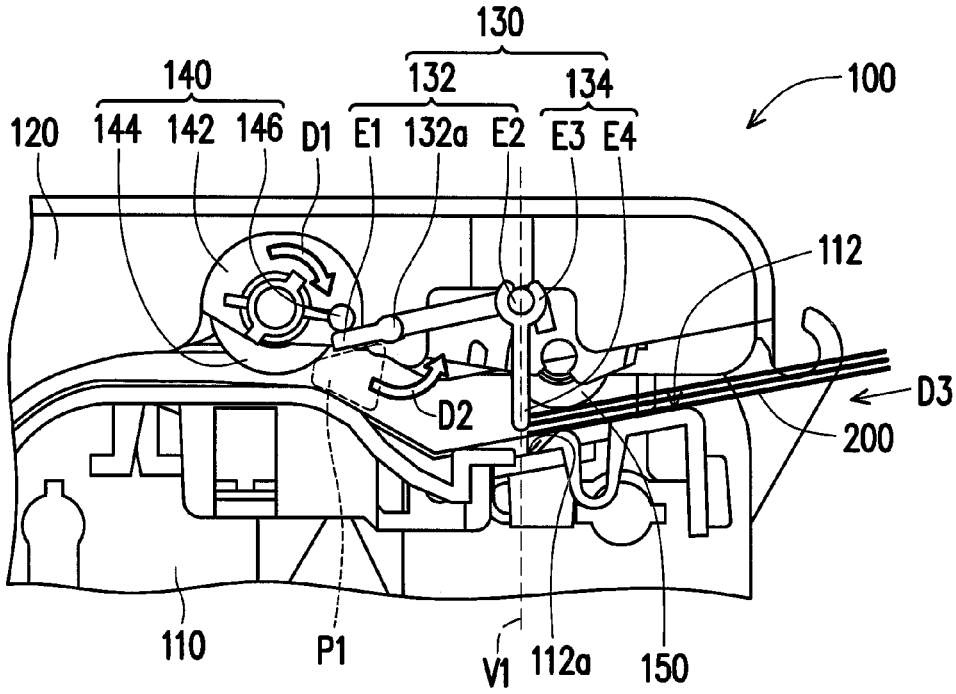
FIGS. 4 and 5 are respectively a schematic diagram sequentially showing the paper sheet in FIG. 2 passes through the blocking member.
Figure 5:
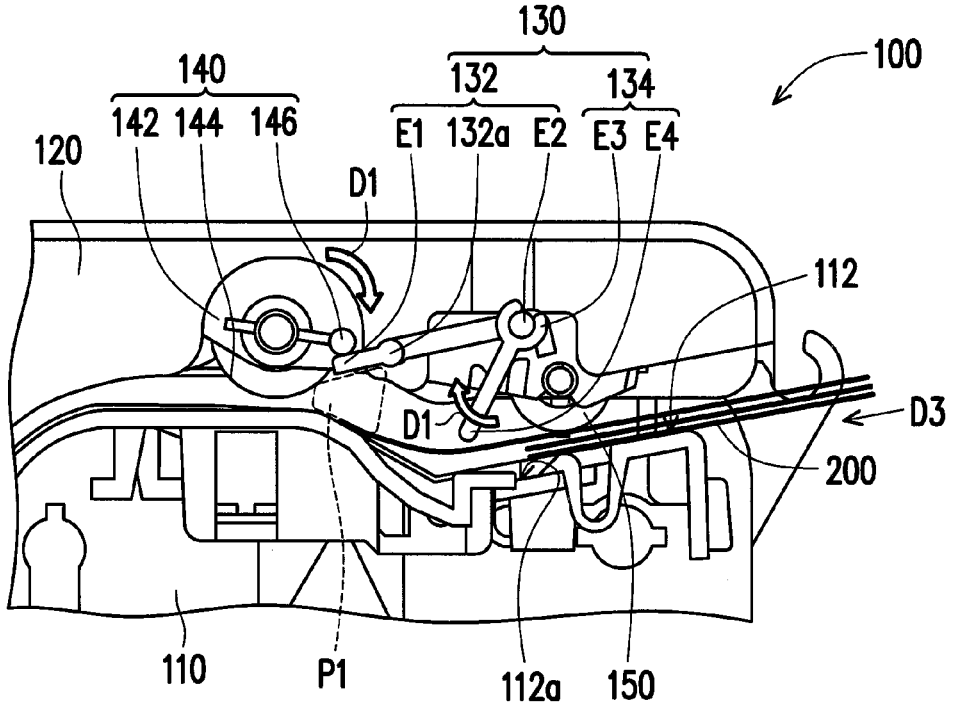

FIGS. 4 and 5 are respectively a schematic diagram sequentially showing the paper sheet in FIG. 2 passes through the blocking member. Referring to FIGS. 1, 2, 4 and 5, in more details, the rail 112 has a retaining portion 112*a*, for example, a locking slot. The driving module 140 includes a supporting frame 142, a roller 144 on the supporting frame 142 and a convex pillar 146, and the first end E1 of the linkage member 132 is located between the convex pillar 146 of the driving module 140 and the buffering space P1.

The roller 144 makes the supporting frame 142 rotate in the first direction D1 by rolling of the roller 144, so that the convex pillar 146 of the driving module 140 moves towards the first end E1 and applies a force onto the first end E1, where the linkage member 132 is driven based on the lever principle to rotate in the second direction D2. Based on the depiction above, as the linkage member 132 is rotating in the second direction D2 due to the function of the driving module 140, the free end E4 of the blocking member 134 would move away from the retaining portion 112*a*. In other words, when the driving module 140 does not apply a force to the first end E1 of the linkage member 132, the gravity of the blocking member 134 makes the linkage member 132 rotate in the first direction D1 and further the free end E4 of the blocking member 134 is thereby locked in the retaining portion 112*a* of the rail 112 so as to achieve the effect of blocking the paper sheet 200 from moving on the rail 112. On the contrary, when the driving module 140 makes the linkage member 132 rotate in the second direction D2, the linkage member 132 would release the free end E4 of the blocking member 134 from locking in the retaining portion 112*a* so that the paper sheet 200 can pass through the rail 112 to enter the body 110.

In addition, the multi-function printer 100 further includes a paper-picking module 150 assembled to the cover 120, which is, for example, a paper-picking roller set. When the driving module 140 drives the linkage member 132 to release the locking between the blocking member 134 and the retaining portion 112*a*, the paper-picking module 150 would makes the paper sheet 200 pass through the rail 112 and move towards into the body 110 by rolling. At the time, since the pivoting end E3 of the blocking member 134 is freely pivoted at the second end E2 of the linkage member 132, the blocking member 134 would not block the moving of the paper sheet 200, i.e., the paper sheet 200 would push the blocking member 134 to rotate in the first direction D1 during the moving of the paper sheet 200.

On the other hand, after the driving module 140 drives the linkage member 132 to release the locking between the blocking member 134 and the rail 112, the pivoting end E3 and free end E4 of the blocking member 134 and the retaining portion 112*a* of the rail 112 are located on a same vertical line V1. Once the paper sheet 200 on the rail 112 completely enters the body 110, the roller 144 no more rolls, and thus, the driving module 140 would rotate in the second direction D2 to return to its initial position (as shown by FIG. 2). At the time, since the first end E1 has no force applied by the driving module 140, the linkage member 132 would rotate towards the first direction D1 due to the gravity force of the blocking member 134 applied at the second end E2, which makes the free end E4 of the blocking member 134 move along the vertical line V1 and is locked in the retaining portion 112*a* again.

It should be noted that, as shown by FIG. 1, the blocking module 130 includes two blocking members 134 respectively at both sides of the rail 112. When the paper sheet 200 enters the rail 112, a front edge A1 of the paper sheet 200 (FIG. 1) would lean against on the blocking member 134 so that the front edge A1 of the paper sheet 200 is perpendicular to the forward direction D3 of the paper sheet 200 on the rail 112. In other words, in addition to blocking the paper sheet 200 from passing through the rail 112, the blocking member 134 can also make the paper sheet 200 get positioning to advance the correctness rate of the desired position of the paper sheet 200 as entering the body 110 and avoid the paper sheet 200 from skewing.

In the embodiment, the roller 144 of the driving module 140 can be coupled to the paper-picking module 150 by means of a linkage mechanism (for example, a set of rollers). In this way, the motion pattern for driving the paper sheet 200 to move can be sequentially and smoothly performed after releasing the interference between the blocking member 134 and the rail 112, but the invention does not limit the formation of the linkage mechanism.

In summary, in the above-mentioned embodiments of the invention, the linkage member of the blocking module is freely pivoted on the cover and the blocking member is pivoted at one of the first and second ends of the blocking module so as to form a simple lever structure. In this way, the blocking module makes the blocking member able to block the paper sheet from passing through the rail by means of the rotation of the linkage member and can drive the linkage member for reverse rotation by means of a counterforce applied by the paper sheet as the blocking member leans against on the paper sheet on the rail, which can effectively avoid the blocking member from damaging the paper stayed on the rail.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A multi-function printer, comprising:

a body, having a rail, wherein a paper sheet is suitable to pass through the rail and conveyed into the body;

a cover, assembled to the body in opened and closed way; and a blocking module, comprising:

a linkage member, having a rotation shaft and a first end and a second end located at the both opposite sides of the rotation shaft, wherein the rotation shaft is freely pivoted at the cover;

a blocking member, pivoted at the second end; and a driving module, assembled to the cover and located beside the first end, wherein the driving module moves towards the first end and applies a force onto the first end so as to drive the linkage member rotating in a second direction, when the driving module does not apply the force onto the first end, the blocking member makes the linkage member rotate in a first direction by means of the gravity thereof, and when the cover is opened relatively to the body, followed by being closed so that the blocking member leans against on the paper sheet on the rail, the paper sheet applies a counterforce onto the blocking member so as to drive the linkage member rotating in the second direction, wherein the first direction is opposite to the second direction.

2. The multi-function printer as claimed in claim 1, wherein the rail has a locking slot, and the linkage member rotates in the first direction and drives a free end of the blocking member to be locked in the locking slot so as to block the paper sheet from passing through the rail and entering the body, when the driving module applies the force onto the first end so as to drive the linkage member rotating in the second direction, the free end of the blocking member moves away from the locking slot.

3. The multi-function printer as claimed in claim 2, further comprising:

a paper-picking module, assembled to the cover, wherein when the driving module drives the linkage member to make the blocking member move away from the locking slot, the paper-picking module drives the paper sheet passing through the rail and moving into the body and pushes the blocking member rotating in the first direction.

4. The multi-function printer as claimed in claim 2, wherein the blocking member further has a pivoting end freely pivoted at the second end, wherein the free end hangs down under the pivoting end due to gravity.

5. The multi-function printer as claimed in claim 4, wherein the pivoting end, the free end and the locking slot are located on a same vertical line.

6. The multi-function printer as claimed in claim 2, wherein a front edge of the paper sheet leans against on the blocking member and the front edge is perpendicular to the moving direction of the paper sheet on the rail.

7. The multi-function printer as claimed in claim 1, wherein there is a buffering space at a side of the first end that the first end is between the buffering space and the driving module, when the linkage member rotates in the second direction, the first end of the linkage member moves towards the buffering space.

* * * * *